US012623694B2

(12) United States Patent
Sichau et al.

(10) Patent No.: US 12,623,694 B2
(45) Date of Patent: May 12, 2026

(54) DRIVE MODULE FOR A SELF-DRIVING VEHICLE, AND SELF-DRIVING VEHICLE

(71) Applicant: Ottobahn GmbH, Pullach im Isartal (DE)

(72) Inventors: Adrian Heinrich Sichau, Holzgerlingen (DE); Bernd Stuke, Leonberg (DE); Felix Jaegle, Ditzingen (DE); Gael Le Hen, Ludwigsburg (DE); Olaf Ohlhafer, Erligheim (DE)

(73) Assignee: Ottobahn GmbH, Pullach im Isartal (DE)

( * ) Notice: Subject to any disclaimer, the term of this patent is extended or adjusted under 35 U.S.C. 154(b) by 724 days.

(21) Appl. No.: 17/801,657

(22) PCT Filed: Feb. 17, 2021

(86) PCT No.: PCT/EP2021/053812

§ 371 (c)(1),
(2) Date: Aug. 23, 2022

(87) PCT Pub. No.: WO2021/175586

PCT Pub. Date: Sep. 10, 2021

(65) Prior Publication Data

US 2023/0347943 A1 Nov. 2, 2023

(30) Foreign Application Priority Data

Mar. 2, 2020 (DE) ..... 10 2020 202 614.9

(51) Int. Cl.
*B61B 3/02* (2006.01)
*B61C 9/38* (2006.01)

(52) U.S. Cl.
CPC . *B61B 3/02* (2013.01); *B61C 9/38* (2013.01)

(58) Field of Classification Search
CPC .... B61B 3/02; B61B 7/06; B61C 9/38; B66C 11/12
See application file for complete search history.

(56) References Cited

U.S. PATENT DOCUMENTS

| | | | | |
|---|---|---|---|---|
| 3,457,876 | A | 7/1969 | Holden | |
| 6,450,318 | B1 | 9/2002 | Minardi | |
| 2017/0072969 | A1* | 3/2017 | Collie | B61B 3/02 |
| 2022/0033231 | A1* | 2/2022 | Akiyama | B66C 11/12 |

FOREIGN PATENT DOCUMENTS

| | | | |
|---|---|---|---|
| CH | 689420 | A5 | 4/1999 |
| DE | 4002181 | A1 | 8/1990 |
| DE | 19819993 | A1 | 11/1999 |
| DE | 10 2018 110907 | A1 | 11/2019 |
| DE | 102019217948 | A1 | 5/2021 |
| FR | 2864508 | A1 | 7/2005 |
| GB | 191122406 | A | 10/1912 |

(Continued)

OTHER PUBLICATIONS

International Search Report for PCT/EP2021/053812, Issued May 19, 2021.

*Primary Examiner* — S. Joseph Morano
(74) *Attorney, Agent, or Firm* — WTA IP Law P.C.

(57) ABSTRACT

A drive module for a self-driving vehicle of an elevated-track-type support structure. The drive module is able to be connected to a support arm for a gondola.

10 Claims, 4 Drawing Sheets

(56) References Cited

FOREIGN PATENT DOCUMENTS

| | | | |
|---|---|---|---|
| GB | 2305645 | A | 4/1997 |
| JP | H03102367 | U | 10/1991 |
| JP | H0478651 | A | 3/1992 |
| JP | H08208178 | A | 8/1996 |
| JP | H1111299 | A | 1/1999 |
| JP | 2006088874 | A | 4/2006 |

* cited by examiner

DRIVE MODULE FOR A SELF-DRIVING VEHICLE, AND SELF-DRIVING VEHICLE

FIELD

The present invention relates to a drive module for a self-driving vehicle of an elevated-rail-type support structure. Within the framework of the present invention, a self-driving vehicle is understood as a vehicle which is able to be moved along the support structure with the aid of the drive module, i.e., with the aid of its own drive. Both autonomously driving, i.e., driverless, vehicles are possible and those that are controlled by a driver or operator. The vehicle may typically be used for transporting persons or freight. In addition, the present invention relates to a self-driving vehicle having a drive module according to the present invention.

BACKGROUND INFORMATION

German Patent Application No. DE 10 2019 217 948 A1 of the Applicant describes a drive module for a self-driving vehicle of an elevated-track-type support structure. This drive module is part of a self-driving vehicle which is characterized by a lifting device by which the gondola can be adjusted from a raised position, which is assumed during the driving operation of the gondola, to a lowered position for loading or unloading the gondola either in the region of a station or else along the driving route, e.g., in emergency situations. It is furthermore described in the cited patent application that the lifting device is developed as a component of a support arm device or of the gondola.

SUMMARY

A drive module for self-driving vehicles according to the present invention may offer the advantage that it allows for a particularly advantageous design of the lifting device and also for an advantageous integration of the lifting device into the self-driving vehicle. According to an example embodiment of the present invention, the drive module is provided with a lifting device for this purpose, which is at least indirectly able to be driven by an electric motor and developed to move the support arm between a raised driving position and a lowered loading or unloading position for the gondola.

In other words, this means that the lifting device—in contrast to the related art mentioned above—is no longer a component of the support arm or the gondola, but a component of a drive module which is used to move the gondola along the support structure. This offers the advantage that all components required to drive or move the gondola along the support structure and to raise or lower the gondola can be positioned within the drive module, and, furthermore, parts or components possibly used for driving the gondola may simultaneously be used as a component of the lifting device.

Advantageous further developments of the drive module for a self-driving vehicle of an elevated-track-type drive module of the present invention are disclosed herein.

In one particularly preferred constructive implementation of the present invention, it is provided that the drive module has a first electric motor for moving the gondola along the support structure and that the lifting device is at least indirectly drivable by the first electric motor. Such an embodiment thus makes it possible to use one and the same electric motor both for driving the gondola along the support structure and for lowering or raising the gondola for loading and unloading purposes. This is advantageous insofar as the drive power of the lifting device is typically lower than the drive power required for moving the gondola along the support structure. As a consequence, it will not be necessary to modify the size or power of the electric motor in comparison with a variant in which the electric motor is not used for operating the lifting device but for driving the gondola. In addition, the use of a single electric motor both for driving the gondola and for driving the lifting device makes it possible to keep the required space in the drive module to a relative minimum and the investment costs at a relatively low level.

In a further development of the present invention, it is provided that the (single) electric motor is alternately able to be coupled with drive rollers for the gondola or the lifting device via a gear unit having at least two coupling devices. The drive rollers are used to move the gondola along the support structure.

In another provided further development of the present invention, it is particularly advantageous if an additional coupling device is provided for blocking the lifting drive when the electric motor is actively connected to the drive elements for the vehicle. This is because the coupling device, which is provided to move the lifting device with the aid of the electric motor, is switched to an open state in this switching state, and it must be avoided that the lifting device is activated, e.g., solely by the weight force of the gondola, or that the gondola will be lowered unintentionally.

According to the present invention, there are also different variants with regard to the switching of the at least two coupling devices, which are connectable to the drive or the drive elements for the gondola on the one hand and to the lifting device on the other hand. In a first variant, it may be provided that the switching of the at least two coupling devices is implemented with the aid of separate actuators for the two coupling devices.

As an alternative, however, it may also be provided to implement the switching of the at least two coupling devices via a shared actuator, the coupling devices then being mechanically coupled with one another.

In yet another alternative example embodiment of the present invention, in the presence of an additional coupling device for blocking the lifting drive, it may be provided that the at least two coupling devices and the additional coupling device are switchable with the aid of a shared actuator.

As an alternative, it is of course also possible that the additional coupling device is switchable with the aid of an additional coupling device, that is, a third actuator.

In an alternative example embodiment of the present invention or the drive for the lifting device and for the drive of the gondola, it may be provided that the drive module has a first electric motor for moving the gondola along the support structure, and that the lifting device is able to be driven with the aid of a second electric motor. Although such an embodiment has the disadvantage of requiring two separate electric motors, it offers advantages with regard to a mechanically simpler structure. More specifically, the devices or coupling devices necessary for the alternate driving of the lifting drive or the gondola if only a single electric motor is provided are able to be dispensed. Also, with a separate motor for the lifting device, its size and thus also its space requirement and cost can be kept relatively low as a rule because only a relatively low drive power is required in comparison with the drive motor for the gondola.

Cable and chain drives for lowering and raising the gondola have shown to be the preferred constructive development of the lifting device. They are especially easy to operate with the aid of the electric motor and/or a cable-winch-type construction and furthermore allow for a high lifting travel at a relative compact design. However, other designs of lifting devices are naturally also possible such as those that employ pulley blocks or similar elements.

In addition, the present invention also encompasses a self-driving vehicle having a drive module according to the present invention. According to an example embodiment of the present invention, during a normal driving operation, that is, with a raised gondola, the support arm must be rigidly or firmly and safely connected to the drive module. Against this background, a further embodiment of the present invention for the self-driving vehicle provides that the support arm is movable relative to the drive module with the aid of the lifting device, and that the support arm can be coupled with the drive module using a coupling which preferably includes a centering aid. The centering aid particularly allows for a defined guidance or limited movement of the support arm relative to the drive module, especially when the gondola is lowered or raised again, and makes it possible to orient the support arm with high accuracy relative to the drive module.

Additional advantages, features and details of the drive module according to the present invention for a self-driving vehicle of an elevated-track-type support structure result from the following description of preferred embodiments and also on the basis of the figures.

DETAILED DESCRIPTION OF EXAMPLE EMBODIMENTS

Figure 1:
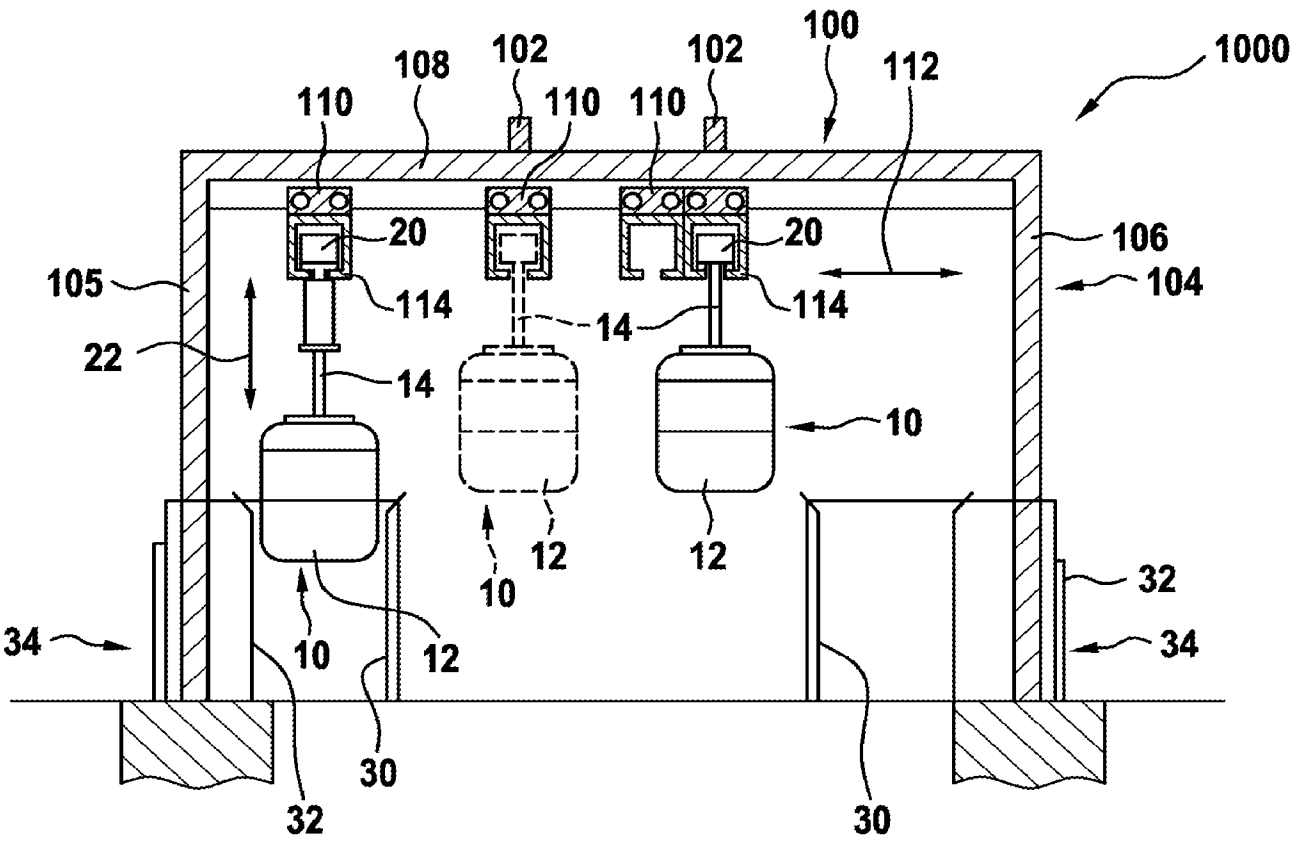
FIG. 1 shows a transport system in the region of a portal structure that allows the gondolas to be raised and lowered with the aid of a lifting device, in a simplified sectional view, according to an example embodiment of the present invention.

Identical elements or elements having the same function have been provided with the same reference numerals in the figures.

FIG. 1 shows a transport system 1000 for self-driving vehicles 10. Transport system 1000 has a support structure 100, which is developed as an elevated track-type support structure 100 and makes it possible to connect different points of transport system 1000 to one another, for instance with the aid of support rails (not shown in FIG. 1) which are suspended on support cables 102 and face downward, vehicles 10 driving along the support rails using their own drive.

In addition, support structure 10 of transport system 1000 usually includes at least and stop or transfer location having a portal-type structure 104 which, by way of example, is made up of two perpendicular supports 105, 106 and at least one cross beam 108 connecting the two supports 105, 106 to each other. In the region of cross beam 108, four support devices 110 are situated, likewise purely by way of example, which are individually movable in the direction of double arrow 112 in the horizontal direction using drives, which are not depicted. With the aid of support device 110, given a position that is aligned with the support rail, a vehicle 10 entering the region of structure 104 is able to be transferred from the support rail fixed in place on the support cable 102 to a guide region 114 of support device 110. After the transfer to support device 110 and a subsequent transverse movement of support device 110 and an alignment of a further support device 110 flush with the support rail (as illustrated for vehicle 10 shown by dashed lines), the former vehicle 10 can be lowered while another vehicle 10 is able to pass through structure 104 without stopping utilizing further support device 10 aligned with the support rail.

Self-driving vehicle 10, which is developed with a gondola 12 for transporting passengers in the illustrated exemplary embodiment, is coupled with a drive module 20 via a support arm 14 situated on the upper side of gondola 12, the drive module being used both for moving gondola 12 along support structure 100 and for raising or lowering support arm 14 together with gondola 12.

To avoid swinging of gondola 12 and support arm 14 relative to drive module 20 while gondola 12 is raised or lowered, e.g., due to wind effects, a device 30 for the horizontal guidance of gondola 12 is furthermore situated at the location where gondola 12 is lowered or raised or in the region of structure 104. By way of example, device 30 is developed in the form of a sleeve as part of a protective housing 32, and protective housing 32 furthermore has a door region 34 by way of which gondola 12 is able to be entered or exited.

With the aid of drive module 20, gondola 12 may be vertically lifted and lowered in the direction of double arrow 22. It is additionally mentioned that lifting or lowering of gondola 12 with the aid of drive module 20 may take place not only in the region of structure 104, but—in case of an emergency, for example—also at any other location of transport system 1000 where no structure 104 and no device 30 is situated, in particular. Gondola 12 may also be developed in such a way that it is used for transporting items or objects.

Figure 2:
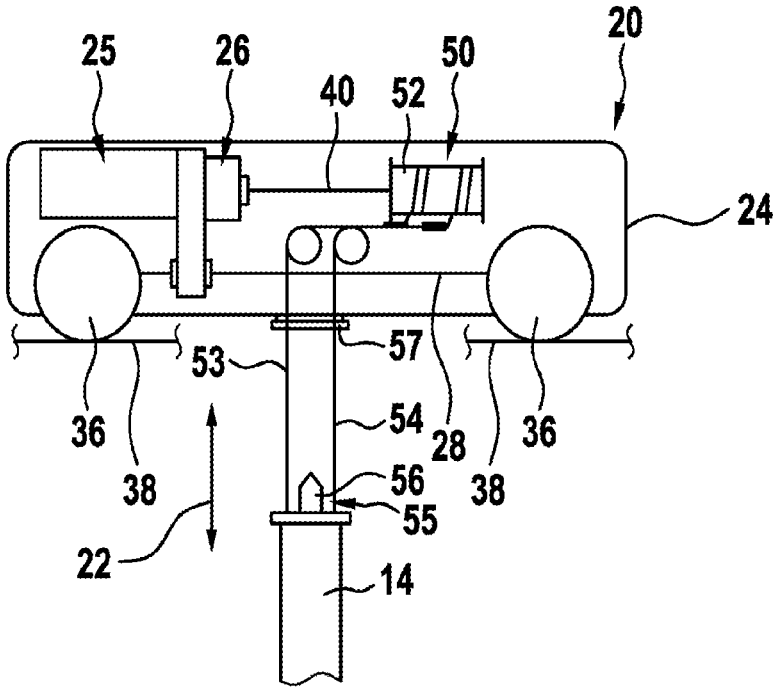
FIG. 2 shows a simplified representation in the region of a drive module of the gondola equipped with a single electric motor both for moving the gondola along the support structure and for driving the lifting device, according to an example embodiment of the present invention.

FIG. 2 shows a first embodiment of drive module 20. By way of example, drive module 20 includes an essentially closed housing 24 in which an electric motor 25 is situated. Via a gear unit 26 and at least one first output shaft 28, electric motor 25 is coupled with a plurality of drive rollers 36 as drive elements for vehicle 10, which in turn interact with a merely schematically sketched support rail 38 in order to move gondola 12 along support rail 38 or along transport system 1000. In addition, electric motor 25 or gear unit 26 is coupled via a second output shaft 40 to a lifting device 50.

For example, lifting device 50 has a cable drum 52, which can be driven via second output shaft 40. Two cables 53, 54 are fixed in place on cable drum 52 and connected to the upper side of support arm 14 of gondola 12. Via a rotation of second output shaft 40 or a rotation of cable drum 52, support arm 14 with gondola 12 thus is able to be raised and lowered in the direction of double arrow 22. To allow for a rigid coupling or connection of support 14 to drive module 20 or to housing 24 during a driving operation, i.e., when support arm 14 is raised, drive module 20 and support arm 14 furthermore have a coupling 55, which by way of example includes a centering pin 56 that projects in a perpendicular fashion from the upper side of support arm 14 and interacts with a mirror-inverted opening (not shown) on a centering plate 57.

The (single) electric motor is used both for moving gondola 12 along support structure 100 and for moving gondola 12 in the direction of double arrow 22 with the aid of lifting device 50. In this context, it is provided that gondola 12 is either moved along support structure 100 with the aid of electric motor 25, or gondola 12 is raised or lowered with the aid of lifting device 50. A simultaneous operation of lifting device 50 and drive rollers 36 with the aid of electric motor 25 is not provided.

Figure 3:
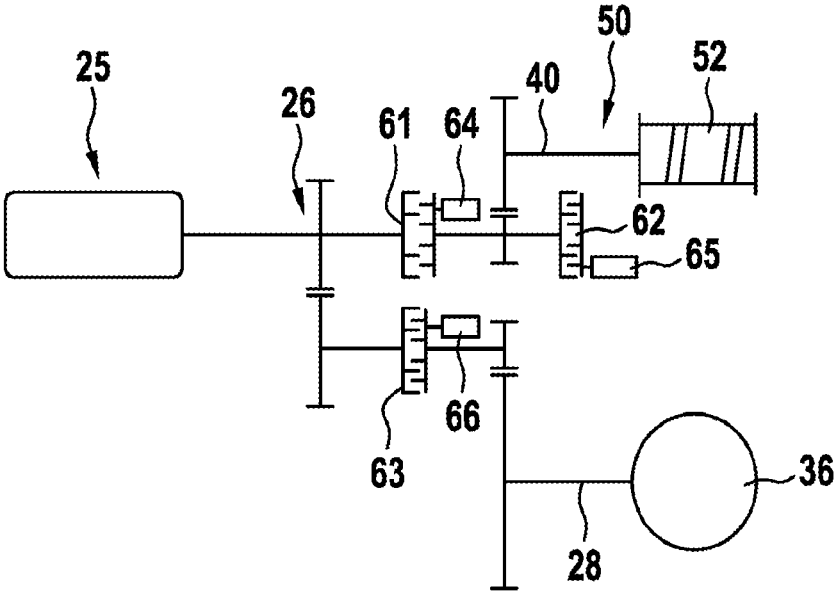
FIG. 3 to FIG. 5 show circuit diagrams regarding the coupling of the electric motor according to FIG. 2 with the drive or the lifting device, according to example embodiments of the present invention.

For such an alternate operation of drive module 20 or electric motor 25, reference is initially made to the illustration of FIG. 3 in the following text. It can be gathered from there that gear unit 26 has a total of three coupling devices 61 through 63. Depicted is a scenario where first coupling device 61 is open while the two other coupling devices 62 and 63 are shown in a closed position.

Coupling devices 61 through 63 are developed as claw couplings by way of example, but other designs of coupling devices 61 through 63 from the related art are also possible.

In addition, a separate actuator 64 to 66 is assigned to each coupling device 61 to 63, which is used to release or close the respective coupling device 61 to 63. First coupling device 61 is situated in the force flow of second output shaft 40, which is used to drive cable drum 52. Second coupling device 62 is also situated in the force flow of second output shaft 40 and used to avoid an unintended lowering of gondola 12 in the scenario shown in FIG. 3, where first coupling device 61 is open, this being accomplished by closing second coupling device 62 in order to avoid a rotation of cable drum 52. Third coupling device 63 is situated in the force flow of first output shaft 28. In the scenario shown in FIG. 3, lifting device 50 is deactivated, whereas a drive or movement of gondola 12 along support structure 100 is possible with the aid of electric motor 25.

Figure 4:
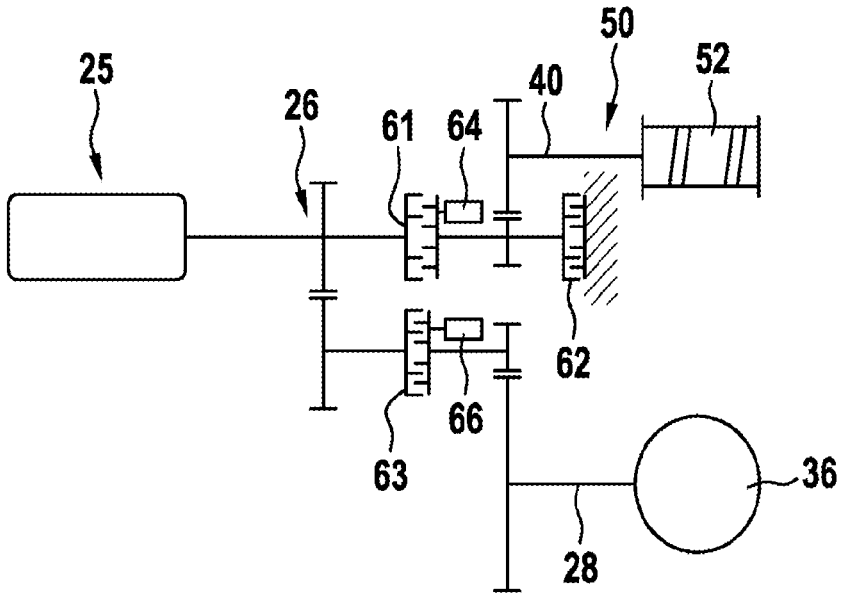

FIG. 4 shows that three coupling devices 61 to 63 are still provided, but only two actuators 64, 66, which are used to operate the two coupling devices 61 and 63. When first coupling device 61 is released, first actuator 64 simultaneously closes third coupling device 63 to avoid a movement of cable drum 52.

Figure 5:
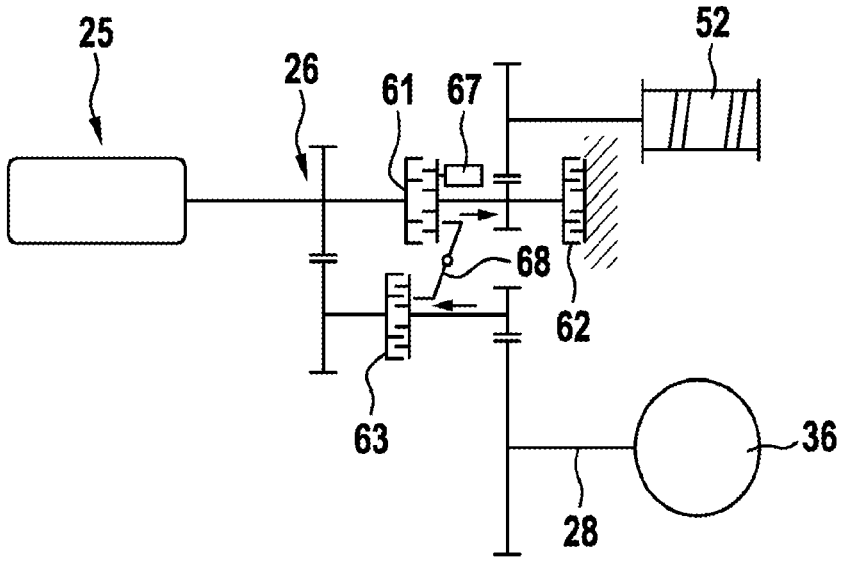

FIG. 5 shows the scenario in which the three coupling devices 61 to 63 are able to be operated by a single actuator 67. First coupling device 61 and third coupling device 63 are mechanically connected via a coupling joint 68 in such a way that when first coupling device 61 is opened, closing of third coupling device 63 is induced at the same time. Similar to the illustration of FIG. 4, a simultaneous movement of second coupling device 62 occurs via actuator 67.

Figure 6:
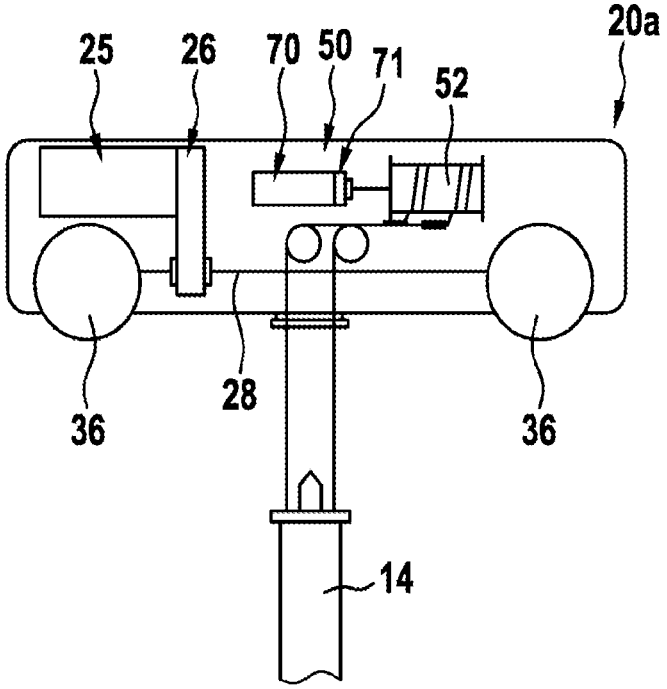
FIG. 6 shows a drive module, modified in comparison with FIG. 2, using separate electric motors for moving the gondola along the support structure and for driving the lifting device, according to the present invention.

Finally, a modified drive module 20 is shown in FIG. 6, which includes a second electric motor 70 in addition to first electric motor 25. Second electric motor 70 is connected to cable drum 52, preferably using an interposed gear unit 71, which means that second electric motor 70 is connected exclusively to lifting device 50 or used to operate lifting device 50. In contrast, (first) electric motor 25 is used exclusively for moving gondola 12 along support structure 100.

Self-driving vehicle 10 as described above is able to be changed or modified in a variety of ways without departing from the present invention.

What is claimed is:

1. A drive module for a self-driving vehicle of an elevated-track-type support structure, the drive module being configured to be connected to a support arm for a gondola, the drive module comprising:

a lifting device configured to move the support arm between a raised driving position and a lowered loading or unloading position for the gondola, wherein the drive module has a first electric motor configured to move the gondola along the support structure, and the lifting device is at least indirectly drivable by the first electric motor, the first electric motor being further configured to be alternately coupled with drive elements for the gondola or the lifting device via gear unit having at least two coupling devices, wherein an additional coupling device is provided to block the lifting device when the first electric motor is actively connected to the drive elements.

2. The drive module as recited in claim 1, wherein the at least two coupling devices are switched using separate actuators.

3. The drive module as recited in claim 1, wherein switching of the at least two coupling devices is implemented via a shared actuator, the at least two coupling devices being mechanically coupled with one another.

4. The drive module as recited in claim 1, wherein the at least two coupling devices and the additional coupling device are switchable using a shared actuator.

5. The drive module as recited in claim 1, wherein the additional coupling device is switchable using an additional actuator.

6. The drive module as recited in claim 1, wherein the lifting device is configured to be driven using a second electric motor.

7. The drive module as recited in claim 1, wherein the lifting device has a cable or chain drive for lowering or raising the gondola.

8. The drive module as recited in claim 1, wherein the drive module has a closed housing.

9. A self-driving vehicle, comprising:

a gondola connected to a support arm; and a drive module connected to the support arm, wherein the drive module includes a lifting device configured to move the support arm between a raised driving position and a lowered loading or unloading position for the gondola, wherein the drive module has a first electric motor configured to move the gondola along a support structure, and the lifting device is at least indirectly drivable by the first electric motor; and wherein the support arm is movable relative to the drive module using the lifting device, and the support arm is configured to be coupled with the drive module using a coupling, wherein the first electric motor is further configured to be alternately coupled with drive elements for the gondola or the lifting device via gear unit having at least two coupling devices, wherein an additional coupling device is provided to block the lifting device when the first electric motor is actively connected to the drive elements.

10. The self-driving vehicle as recited in claim 9, wherein the coupling includes a centering aid.

* * * * *